United States Patent [19]

Coyle et al.

[11] Patent Number: 4,995,996

[45] Date of Patent: Feb. 26, 1991

[54] MOLYBDENUM SULFUR ANTIWEAR AND ANTIOXIDANT LUBE ADDITIVES

[75] Inventors: Catherine L. Coyle, Mendham, N.J.; Mark A. Greaney, Upper Black Eddy, Pa.; Edward I. Stiefel, Bridgewater, N.J.; James N. Francis, Maplewood, N.J.; Morton Beltzer, Westfield, N.J.

[73] Assignee: Exxon Research and Engineering Company, Florham Park, N.J.

[21] Appl. No.: 450,751

[22] Filed: Dec. 14, 1989

[51] Int. Cl.[5] ..... C10M 135/14

[52] U.S. Cl. ..... 252/42.7; 252/46.4

[58] Field of Search ..... 252/42.7

[56] References Cited

U.S. PATENT DOCUMENTS

| | | | |
|---|---|---|---|
| 2,951,040 | 8/1960 | Hugel et al. | 252/33.6 |
| 4,259,254 | 3/1981 | Bridger | 252/42.7 |

*Primary Examiner*—Olik Chaudhuri
*Assistant Examiner*—Ellen McAvoy
*Attorney, Agent, or Firm*—Joseph J. Dvorak

[57] ABSTRACT

In accordance with this invention, there is provided a lubricating composition comprising a major amount of an oil of lubricating viscosity and a minor amount of an additive having the formula $Mo_2L_4$ wherein L is a ligand selected from xanthates and mixtures thereof and, in particular, xanthates having a sufficient number of carbon atoms to render the additive soluble in the oil. In general, the xanthate ligand, L, will have form about 2 to 30 carbon atoms.

9 Claims, No Drawings

MOLYBDENUM SULFUR ANTIWEAR AND ANTIOXIDANT LUBE ADDITIVES

FIELD OF THE INVENTION

This invention relates to improved lubricating compositions.

BACKGROUND OF THE INVENTION

Molybdenum disulfide is a known lubricant additive. Unfortunately, it has certain known disadvantages which are associated with the fact that it is insoluble in lubricating oils. Therefore, oil soluble molybdenum sulfide containing compounds have been proposed and investigated as lubricant additives. For example, in U.S. Pat. No. 2,951,040, an oil soluble molybdic xanthate is disclosed as being useful in lubricating compositions. Apparently, the molybdic xanthate decomposes under conditions of use to form an oil insoluble molybdenum sulfide on the metal surfaces being lubricated.

U.S. Pat. No. 4,013,571 discloses the use of certain thiosulfenyl xanthates in ashless lubricant compositions.

U.S. Pat. No. 4,259,254 discloses the use of xanthate containing molybdenum compounds in lubricating oil compositions.

U.S. Pat. No. 4,369,119 discloses an antioxidant additive for lubricating oils which is prepared by reacting an acidic molybdenum compound with a basic nitrogen compound and a sulfur compound and combining that product with an organic sulfur compound. In this regard, see also U.S. Pat. No. 4,395,343 and U.S. Pat. No. 4,402,840.

U.S. Pat. No. 4,474,673 discloses antifriction additives for lubricating oils which are prepared by reacting a sulfurized organic compound having an active hydrogen or potentially active hydrogen with molybdenum halide.

U.S. Pat. No. 4,497,719 discloses the use of metal salts of thiadiazole, such as molybdenum salts of thiadiazole as antiwear lube additives.

The foregoing patents are listed as representative of the many known molybdenum sulfur containing lubricant additives.

As is known in the art, some lubricant additives function as antiwear agents, some as antifriction agents and some as extreme pressure agents. Indeed, some additives may satisfy more than one of these functions. For example, metal dialkyl dithiophosphates represent a class of additives which are known to exhibit antioxidant and antiwear properties. The most commonly used additives of this class are the zinc dialkyl dithiophosphates. These compounds provide excellent oxidation resistance and exhibit superior antiwear properties. Unfortunately, they do not have the most desirable lubricity. Therefore, lubricating compositions containing these compounds also require the inclusion of antifriction agents. This leads to other problems in formulating effective lubricant compositions.

Additionally, extreme care must be exercised in combining various additives to assure both compatibility and effectiveness. For example, some antifriction agents affect the metal surfaces differently than the antiwear agents. If each type of additive is present in a lubricant composition, each may compete for the surface of the metal parts which are subject to lubrication. This can lead to a lubricant that is less effective than expected based on the properties of the individual additive components.

Thus, there still remains a need for improved lubricating oil additives that can be used with standard lubricating oils and that are compatible with other conventional components of the lubricating oil compositions.

SUMMARY OF THE INVENTION

In accordance with this invention, there is provided a lubricating composition comprising a major amount of an oil of lubricating viscosity and a minor amount of an additive having the formula $Mo_2L_4$ wherein L is a ligand selected from xanthates and mixtures thereof and, in particular, xanthates having a sufficient number of carbon atoms to render the additive soluble in the oil. In general, the xanthate ligand, L, will have from about 2 to about 30 carbon atoms.

The amount of additive employed in the composition of the present invention will range from about 0.1 to about 10 wt. % based on the weight of oil and, preferably, in the range of about 0.1 to about 1.0 wt. %.

The lubricant compositions according to this invention have excellent antiwear, antioxidant and friction reducing properties. The lubricant compositions of the present invention also are compatible with other standard additives used in formulating commercial lubricating compositions.

DETAILED DESCRIPTION OF THE INVENTION

The lubricating composition of the present invention includes a major amount of an oil of lubricating viscosity. This oil may be selected from naturally occurring mineral oils or from synthetic oils. The oils may range in viscosity from light distillate mineral oils to heavy lubricating oils such as gas engine oil, mineral lubricating oil, motor vehicle oil and heavy duty diesel oil. In general, the viscosity of the oil will range from about 5 centistokes to about 26 centistokes, and especially in the range of 10 centistokes to 18 centistokes at 100° C.

The lubricating composition of the present invention includes a minor amount of an additive having the formula $Mo_2L_4$ in which L is a xanthate ligand and preferably in which the number of carbon atoms in the ligand is sufficient to render the additive soluble in oil. For example, the additive will have the formula $$Mo_2(ROCS_2)_4$$

wherein R is selected from alkyl groups, aralkyl groups, alkoxylalkyl groups and the like. When R is an alkyl group, the number of carbon atoms in the alkyl group will generally range between about 1 to about 30 and, preferably, between about 2 to 12.

The additives of the present invention may be prepared by generally known techniques. For example, an alkali metal xanthate may be reacted with dimolybdenum tetra-acetate to produce the $Mo_2L_4$ compound. (See Webb, T. R. et al, Inorg. Chim. Acta., 49, 107, 1981.)

The above described $Mo_2L_4$ complexes are effective as additives in lubricating compositions when they are used in amounts ranging from about 0.01 to 10 wt. % based on the weight of the lubricating oil and, preferably, in concentrations ranging from about 0.1 to 1.0 wt. %.

Concentrates of the additive of the present invention in a suitable diluent hydrocarbon carrier provide a convenient means of handling the additives before their use. Aromatic hydrocarbons, especially toluene and xylene, are examples of suitable hydrocarbon diluents for additive concentrates. These concentrates may contain about 1 to 90 wt. % of the additive based on the weight of diluent, although it is preferred to maintain the additive concentration between about 20 and 70 wt. %.

If desired, other known lubricant additives can be used for blending in the lubricant compositions of this invention. These include ashless dispersants detergents, pour point depressants, viscosity improvers and the like. These can be combined in proportions known in the art.

The invention will be more fully understood by reference to the following preparative procedures, examples and comparative examples illustrating various modifications of the invention, which should not be construed as limiting the scope thereof.

Procedure for Preparation of $Mo_2$(Octylxanthate)$_4$ 0.98 grams (4.0 mmol) of potassium oxtylxanthate was dissolved in 25 ml of degassed methanol and added to 0.43 grams (1.0 mmol) of dimolybdenum tetra-acetate dissolved in 75 ml of degassed methanol. After stirring for approximately 1 hour, bright red crystals of $Mo_2$(xanthate)$_4$ were isolated from the dilute green solution by filtration. These crystals were washed with degassed methanol three times (20 ml each time) and vacuum dried to yield 0.94 grams (93%) of $Mo_2$(octylxanthate)$_4$.

EXAMPLES 1 to 3

These examples illustrate the antiwear properties of a lubricating composition containing a dimolybdenum tetraxanthates in accordance with the invention.

In these examples, the additive prepared by the procedure outlined above was evaluated for wear protection using the Four-Ball Wear Test procedure (ASTM Test D2266). In Example 1, the sample tested consisted of Solvent 150 Neutral (S150) lubricating oil and 0.5 wt. % of the $Mo_2L_4$ additive. In Examples 2 and 3, the sample consisted of a commercially available motor oil which did not contain zinc dithiophosphate (ZDDP) and, instead, contained 0.5 wt. % of the $Mo_2L_4$ additive. The results of these tests are given in Table 1.

COMPARATIVE EXAMPLES 1 to 4

In Comparative Example 1, the Four-Ball Wear Test procedure was conducted using Solvent 150 Neutral. In Comparative Example 2, the test was repeated using Solvent 150 Neutral containing 1.4 wt. % of zinc dithiodiphosphate (ZDDP). In Comparative Example 3, the test was again repeated, in this instance using a commercially available motor oil which did not contain any zinc dithiophosphate (ZDDP). And finally, another Comparative Example, 4, was conducted, in this instance using a commercially formulated motor oil containing 1.4 wt. % zinc dithiodiphosphate (ZDDP). The results are also given in Table 1.

TABLE 1

| Run | Oil | Additive[1] | Wt. % | Wear Volume $mm^3 \times 10^4$ | % Wear Reduction |
|---|---|---|---|---|---|
| Ex. 1 | S150N | $Mo_2L_4$ | .5 | 5.2 | 99 |
| Comp. Ex. 1 | S150N | None | — | 540 | 0 |
| Comp. Ex. 2 | S150N | ZDDP | 1.4 | 29 | 95 |
| Ex. 2 | CB[2] | $Mo_2L_4$ | .5 | 2 | 99.6 |
| Ex. 3 | CB[2] | $Mo_2L_4$ | .5 | 11 | 98 |
| Comp. Ex. 3 | CB[2] | None | — | 545 | 0 |

TABLE 1-continued

| Run | Oil | Additive[1] | Wt. % | Wear Volume $mm^3 \times 10^4$ | % Wear Reduction |
|---|---|---|---|---|---|
| Comp. Ex. 4 | CB[2] | ZDDP | 1.4 | 13 | 97.6 |

1. L in the additive $Mo_2L_4$ = octylxanthate
2. CB = Commercially blended motor oil, but without ZDDP, except where specified

EXAMPLE 4

A differential scanning calorimetry (DSC) test was conducted on a lubricating oil containing the additive of this invention. In this DSC test, a sample of the oil is heated in air at a programmed rate; e.g., 5° C./minute and the sample temperature rise relative to an inert reference was measured. The temperature at which an exothermic reaction (the oxidation onset temperature) is a measure of oxidative stability of the sample. In this Example 4, the sample consisted of S150N and 0.5 wt. % of the $Mo_2L_4$ additive prepared as outlined above. The results of this test are shown in Table 2 below.

A lube oil stability test was also conducted. This test involves measuring the kinematic viscosity of the sample at 40° C., heating the sample at 172° C. for 46 hours while passing air through the sample (flow rate—1 liter/min.) and remeasuring the kinematic viscosity at 40° C. The percent increase in the viscosity is an indication of oxidation. The results of this test are also shown in Table 2.

COMPARATIVE EXAMPLES 5 AND 6

For comparative purposes, the DSC test and the lube stability test were conducted on samples of S150N (Comp. Ex. 5) and a fully formulated commercial motor oil (Comp. Ex. 6). The results of this test are also given in Table 2 below.

TABLE 2

| Run | Oil | Additive[1] | Wt. % | DSC Oxidation Onset Temp. °C. | Lube Stability Test, % Viscosity Increase |
|---|---|---|---|---|---|
| Ex. | S150N | $Mo_2L_4$ | .5 | 273 | 9 |
| Comp. Ex. | S150N | None | — | 210 | TVTM[2] |
| Comp. Ex. | CB[3] | N/A | — | 266 | 19 |

[1]L in the additive $Mo_2L_4$ = octylxanthate
[2]TVTM = Too viscous to measure

EXAMPLE 7

This example illustrates the friction reducing properties of the lubricating compositions of this invention.

For the purpose of this example, friction measurements were performed in a ball on cylinder friction tester using S150N base oil containing 0.5 wt. % of $Mo_2L_4$ where L is octylxanthate. This test employs a 12.5 mm diameter stationary ball and a rotating cylinder 43.9 mm in diameter. Both components were made from AISI 52100 steel. The steel balls were used in the heat treated condition with a Vickers hardness of 840, the cylinders used in the normalized condition with a Vickers hardness of 215.

The cylinder rotates inside a cup containing sufficient quantity of lubricant such that 2 mm of the cylinder bottom is submerged. The lubricant is carried to the ball contact by the rotation of the cylinder.

A normal force of 9.8 N was applied to the ball through dead weights, the cylinder rotated at 0.25 RPM to ensure boundary lubrication conditions prevailed. The friction force was continuously monitored through a load transducer by measuring the tangential force on the ball. Friction coefficients attain steady state values after 7 to 10 turns of the cylinder.

It is well known that stearic acid is an excellent friction modifier. Under the conditions stated above, the minimum friction coefficient obtained with stearic acid in hexadecane is 0.077. With 0.5 wt. % $Mo_2L_4$, the friction coefficient is 0.037, exceptionally low friction under boundary lubrication conditions. Commercial friction modifiers in these ball on cylinder tests exhibit friction coefficients ranging from 0.12 to 0.14. S150N without any additives has a friction coefficient under these conditions of 0.30.

We claim:

1. A lubricating composition comprising: a major amount of an oil of lubricating viscosity; and, a minor amount of an additive having the formula $Mo_2L_4$ wherein L is a ligand selected from a xanthate and mixtures of xanthates.

2. The composition of claim 1 wherein the ligand, L, has organo groups having carbon atoms in an amount sufficient to render the additive soluble in the oil.

3. The composition of claim 2 wherein the amount of the additive is in the range of from about 0.01 to about 10 weight percent based on the weight of oil.

4. The composition of claim 3 wherein the organo groups are selected from alkyl, aralkyl and alkoxylalkyl ether groups.

5. The composition of claim 4 wherein the organo groups are alkyl groups and the number of carbon atoms in the alkyl groups of the ligand, L, are in the range of from about 2 to about 30.

6. A lubricating composition comprising: a major amount of an oil selected from natural and synthetic oils having viscosities in the range of from about 5 to about 26 centistokes at 100° C., and from about 0.01 to about 10 weight percent of an additive having the formula $Mo_2L_4$, wherein L is selected from a xanthate and mixtures of xanthates and wherein the ligand, L, has organo groups having from about 2 to about 30 carbon atoms.

7. The composition of claim 6 wherein the additive is present in an amount ranging from about 0.1 to about 1.0 weight percent.

8. An additive concentrate for blending with lubricating oils to provide a lubricating composition having antiwear, antioxidant and friction reducing properties comprising: a hydrocarbon diluent and from about 1 to about 90 weight percent of an additive, based on the weight of diluent, the additive having the formula $Mo_2L_4$ wherein L is a ligand selected from xanthate and mixtures thereof and wherein the ligand, L, has organo groups having from about 1 to about 30 carbon atoms.

9. The concentrate of claim 8 wherein the diluent is an aromatic hydrocarbon and the additive ranges between about 20 to about 70 weight percent, based on the weight of diluent.

* * * * *